US006050015A

United States Patent [19]

Lurie

[11] Patent Number: 6,050,015

[45] Date of Patent: Apr. 18, 2000

[54] DISPLAY FRAME

[75] Inventor: Neil Lurie, New York, N.Y.

[73] Assignee: Bragley Manufacturing Co., Inc., Brooklyn, N.Y.

[21] Appl. No.: 08/900,597

[22] Filed: Jul. 25, 1997

[51] Int. Cl.[7] ..... G09F 1/12

[52] U.S. Cl. ..... 40/783; 40/719; 52/645

[58] Field of Search ..... 40/719, 780, 782, 40/783, 784, 155; 52/645; 403/401, 402, 403

[56] References Cited

U.S. PATENT DOCUMENTS

| | | | |
|---|---|---|---|
| 533,125 | 1/1895 | Hinckley | 40/719 |
| 1,788,209 | 1/1931 | Sheehan | 40/780 |
| 2,733,788 | 2/1956 | Farmer . | |
| 2,935,165 | 5/1960 | Elliot . | |
| 3,124,225 | 3/1964 | Rosenberg . | |
| 3,255,544 | 6/1966 | Bornholt | 40/768 X |
| 4,444,525 | 4/1984 | Alander . | |
| 4,477,990 | 10/1984 | Buchanan | 40/784 |
| 4,694,519 | 9/1987 | Benoit . | |
| 4,738,039 | 4/1988 | Sun et al. | 40/784 |
| 4,922,638 | 5/1990 | Litvak et al. | 40/783 |
| 5,092,063 | 3/1992 | Shultz . | |
| 5,477,628 | 12/1995 | Chen | 40/784 |

*Primary Examiner*—Brian K. Green
*Attorney, Agent, or Firm*—Collard & Roe, P.C.

[57] ABSTRACT

A window display frame having a top panel, a bottom panel and two side panels. Each panel has an inner surface defining a channel for placement of the replacement window, an outer surface, and two ends. Each side panel has a longitudinal groove extending from each end along the center of the outer surface to an end point, and a bore located adjacent each end point. The bore preferably has a depth that is greater than the depth of the groove. There are four L-shaped corner brackets mounted one on each end of the top and bottom panels. Each corner bracket comprises two legs, an inner surface, an outer surface and inwardly flanged edges. Each end of the top and bottom panels is attached to and fits snugly into the inner surface of one leg of a corner bracket between the flanged edges. The free leg of each corner bracket can then be used for attachment to a side panel to complete the frame. The free leg of each corner panel has a protrusion located on the inner surface. The frame is assembled around a replacement window by sliding the grooves in the side panels along the protrusions in the corner panels until the protrusions snap into the bores in the side panels, so that the replacement window is secured in the channels on the inside surfaces of the panels.

11 Claims, 3 Drawing Sheets

DISPLAY FRAME

BACKGROUND OF THE INVENTION

1. Field of the Invention

This invention relates to a portable frame for displaying replacement windows. In particular, this invention relates to a display frame that is easily assembled by the end user without any tools, and which serves as a portable carrier and display frame for replacement windows.

2. The Prior Art

Display frames for replacement windows are used by window salespeople who travel door-to-door to sell the windows. The frames are usually constructed of wood and surround the replacement window frame and are equipped with a handle on one side edge for carrying. Ease of transportation of the display frames is essential since many of the windows are sold door-to-door.

Two display frames are shown in U.S. Pat. No. 2,935,165 to Elliott and U.S. Pat. No. 3,124,225 to Rosenberg, both of which show window display frames which also have an outer frame members that fold apart and serve as a stand for the display frame. While these outer members are suitable for standing the display frame, they add considerable weight and complexity to the display frame.

Because even the smallest working prototype of a replacement window requires a large and cumbersome frame, shipping large quantities of such display frames can be difficult and very expensive. However, shipping the frames in an unassembled state has the drawback that the frame must then be assembled by the salesperson, who may not have the tools or expertise to assemble the frame.

SUMMARY OF THE INVENTION

It is therefore an object of the present invention to provide a replacement window display frame that is durable yet easy to carry.

It is another object of the present invention to provide a replacement window display frame that can be shipped in a disassembled state and easily assembled without tools.

It is yet another object of the present invention to provide a replacement window display frame that is simple and inexpensive to manufacture.

It is a further object of the present invention to provide a replacement window display frame that has a simple mechanism to keep the frame stable in a free-standing position for display.

These and other objects of the present invention are accomplished by a window display frame comprising a top panel, a bottom panel and two side panels. Each panel has an inner surface defining a channel for placement of the replacement window, an outer surface, and two ends.

Each side panel has a longitudinal groove extending from each end along the center of the outer surface to an end point, and a bore located adjacent each end point. The bore preferably has a depth that is greater than the depth of the groove.

There are four L-shaped corner brackets mounted one on each end of the top and bottom panels. Each corner bracket comprises two legs, an inner surface, an outer surface and flanged edges. Each end of the top and bottom panels is attached to and fits snugly into the inner surface of one leg of a corner bracket between the flanged edges. The free leg of each corner bracket can then be used for attachment to a side panel to complete the frame.

The free leg of each corner panel has a protrusion located on the inner surface. The frame is assembled around a replacement window by sliding the grooves in the side panels along the protrusions in the corner panels until the protrusions engage the bores in the side panels. The replacement window is preferably manufactured to fit snugly within the channels of the frame. The replacement window is thus secured in the channels on the inside surfaces of the panels. Once the protrusions are snapped into the bores, the frame cannot be easily taken apart and is thus permanently and securely assembled around the replacement window.

The corner brackets are preferably made of PLASTIC, with enough thickness to be sturdy, but yet flexible enough to allow the protrusions to snap into the bores. This assembly takes place with minimal effort and without the use of any tools, so that each individual salesperson can easily assemble their own frames. After assembly, each frame is sturdy and secure and will not become disassembled even with heavy wear.

Preferably, the ends of the panels are beveled so that the outer surface of each panel is longer than the inner surface of each panel. This way, upon assembly into the frame, adjacent panels fit together to form right angles. The ends of the panels are preferably beveled at a 45° angle. This angle maximizes the contact surface area between two adjacent panels and minimizes rocking in the frame.

The panels are preferably made from vacuum-extruded particle board or flakeboard that is then coated with a water-resistant coating such as vinyl. This method of manufacture ensures that each panel is precisely formed. In addition, the use of the particle board ensures that the frame will be extremely sturdy and durable, yet inexpensive to manufacture.

The corner pieces are preferably RIVETED to the top and bottom panels prior to shipment to the dealer and assembly. This way, the only assembly that is required is inserting the side panels into the corner pieces and snapping the protrusions into the bores. The entire frame can be shipped in a disassembled, compact shape, which is significantly less expansive than shipping the frame in an assembled state.

In a preferred embodiment, platforms are integrally formed with the legs of at least two of the corner pieces. The platforms extend outward from the sides of the corner pieces and protect the frame from abrasion when the frame is placed on a surface. Preferably, the platforms span the legs of the corner pieces along two adjacent sides of the frame so that the frame can be placed on a surface in two different positions, while still being protected by the platforms. The platforms are preferably integrally molded with the corner pieces and extend outward from the legs of the corner pieces.

An elongated board is pivotally mounted to one of the side panels, and stabilizes the frame in an upright position when the board is pivoted perpendicular to the side panels. During transportation and when the frame is not in use, the board is pivoted to lie parallel to the side panels and stay out of the way. The board also works in conjunction with the platforms on the same side to add additional stability to the frame when it is placed in an upright position. In addition, a handle is preferably attached to the outer surface of one of the panels to enable the user to easily transport the frame from place to place.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
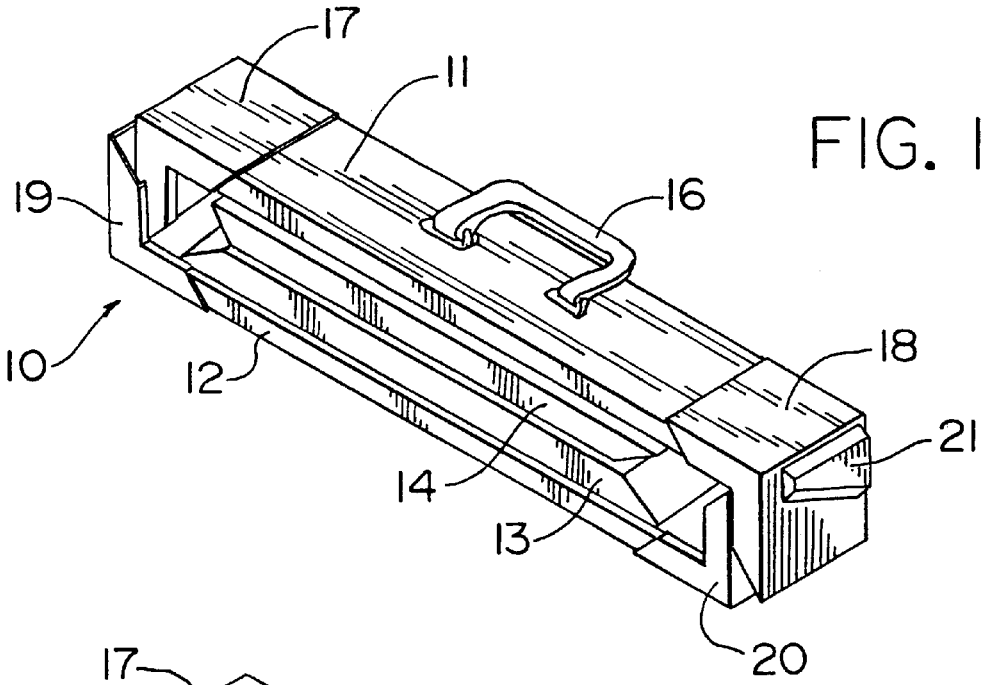
FIG. 1 is a perspective view of the frame assembly according to the present invention in the disassembled state.
Figure 2:
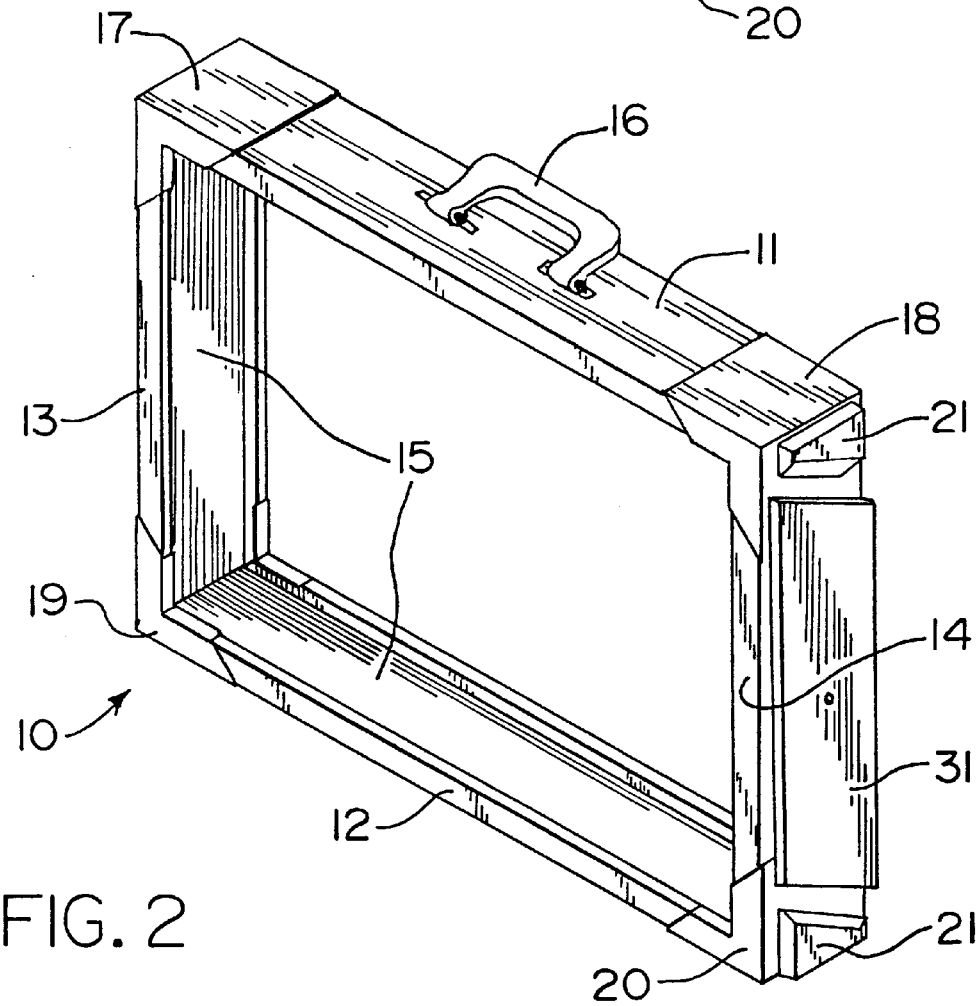
FIG. 2 is a perspective view of the frame assembly according to the present invention in the assembled state.
Figure 3:
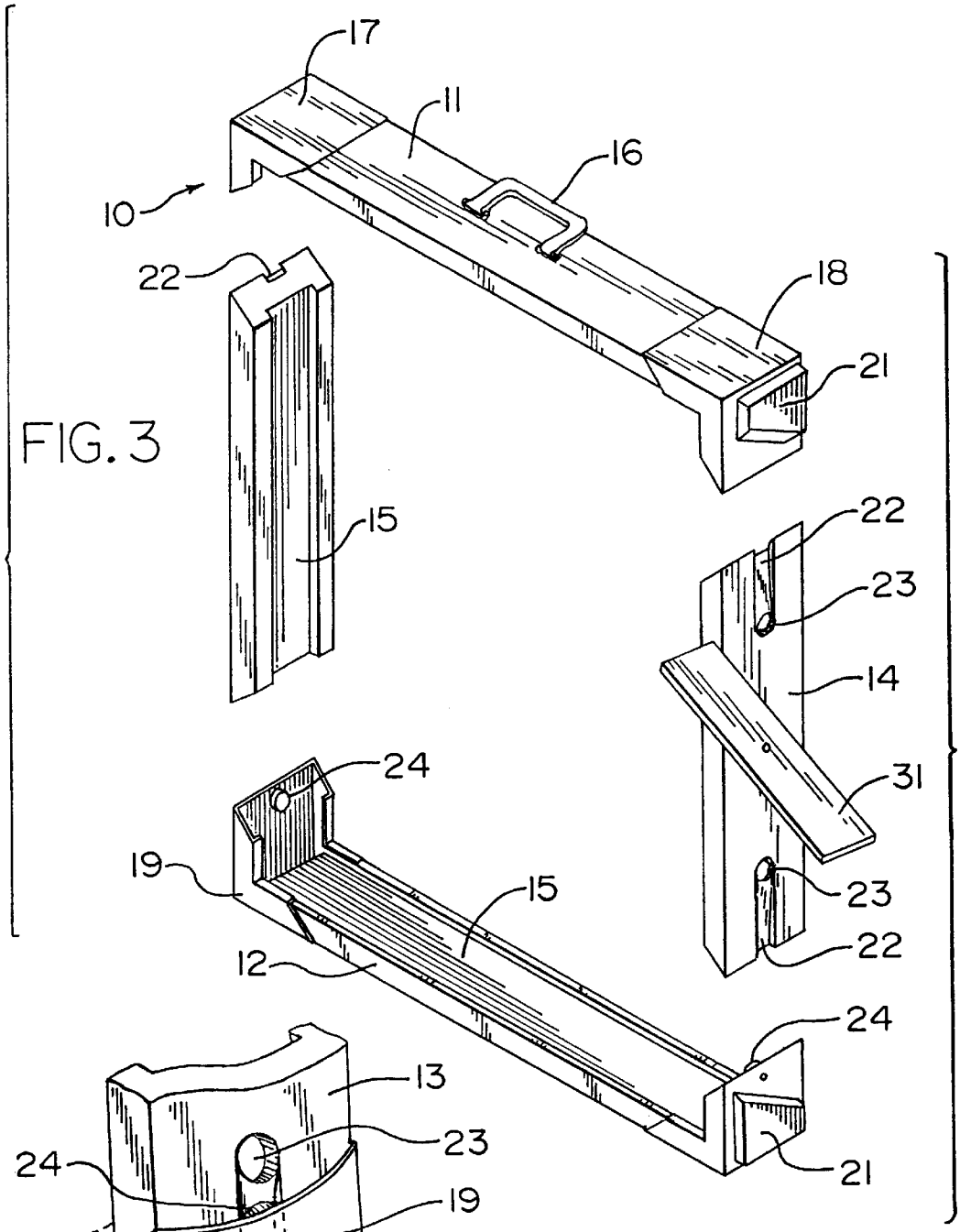
FIG. 3 is an exploded view of the frame assembly according to the present invention.

Turning now in detail to the drawings, and in particular, FIGS. 1–3, there are shown several views of the frame 10 according to the invention. Frame 10 is comprised of top panel 11, bottom panel 12, and side panels 13 and 14. Each of panels 11, 12, 13 and 14 have a channel 15 extending through their length. Channel 15 serves to hold a replacement window in place after the frame is assembled around the window.

A handle 16 is mounted on top panel 11 and enables the user to easily carry the frame from place to place. Four L-shaped corner pieces 17, 18, 19 and 20 are mounted to the ends of top panel 11 and bottom panel 12. Corner pieces 17–20 are made of vacuum FORMED PLASTIC and have the same width as panels 11 and 12. Corner pieces 17–20 have inwardly flanged edges that conform to the thickness of panels 11–14 and serve to wrap around the edges of panels 11–14 to keep them in an assembled state. As shown in FIG. 1, in the disassembled state, one leg of corner pieces 17–20 is permanently mounted to top panel 11 and bottom panel 12 with RIVETS 30. Each corner piece then has a free leg for attachment to one of side pieces 13 and 14.

As can be seen in FIGS. 1–3 and 5, several of the corner pieces 17–20 have platforms 21 integrally formed thereon on at least one of the legs of the corner pieces. Platforms 21 serve to keep frame 10 from becoming scratched or abraded when placed down on rough surfaces. Preferably, platforms 21 are positioned so that they protect two adjacent sides of frame 10, such as side panel 14 and bottom panel 12. This way, frame 10 can be set up two different ways and still have its contact surface be protected. In addition, platforms 21 also add additional stability when a pivoting stabilizing board 31 is used, as shown.

In the disassembled state, side panels 13 and 14 are not attached to corner pieces 17–20. Side panels 13 and 14 are inserted into corner pieces 17–20 when frame 10 is ready to be assembled by the end user. To facilitate assembly, side panels 13 and 14 are each equipped with grooves 22 that extend from each end of side panels 13 and 14 to a point approximately half-way to the center point of each side panel. Adjacent the end point of each groove 22 but beyond the end point of groove, a bore 23 is positioned. Bore 23 is preferably slightly deeper than groove 22, and is located beyond the end point of groove 22.

Figure 4:
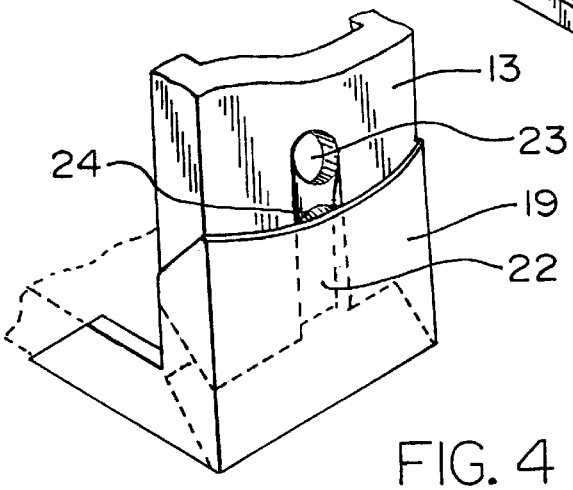
FIG. 4 is a perspective view of a corner piece and portion of a side panel of the frame according to the present invention.
Figure 5:
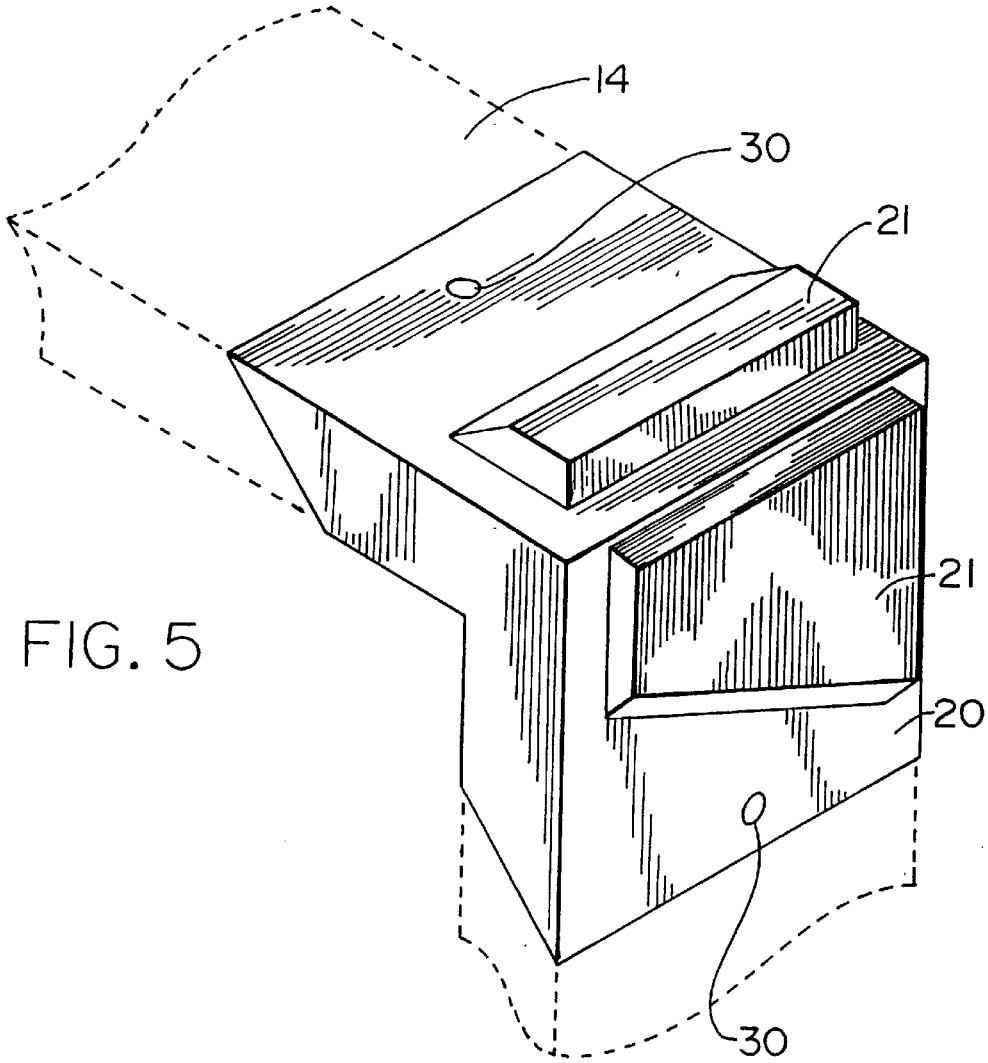
FIG. 5 is a perspective view of a corner piece of the frame according to the present invention.

Each one of corner pieces 17–20 is equipped with a protrusion 24 that corresponds to the size and location of bores 23. To assemble frame 10, side pieces 13 and 14 are inserted into corner pieces 17–20 by sliding grooves 22 along protrusions 24 until protrusions 24 snap into bores 23 as shown in FIG. 4. Side panels 13 and 14 are kept in place within corner pieces 17–20 by the wrap-around edges of corner pieces 17–20 and also through the use of beveled edges on all of the panels. The beveled edges abut one another after assembly and keep the entire frame 10 in a tensioned, assembled position. The beveled edges are cut at a 45° angle, to maximize the contact surface area between adjacent panels. This cut minimizes rocking when frame 10 is assembled.

Once protrusions 24 snap into bores 23, frame 10 is permanently assembled and does not easily come apart. Assembly takes place around a replacement window so that the replacement window is securely held in channels 15 of frame 10. Protrusions 24 are long enough to create a secure connection with bores 23, but short enough to enable them to be easily snapped into bores 23.

Figure 6:
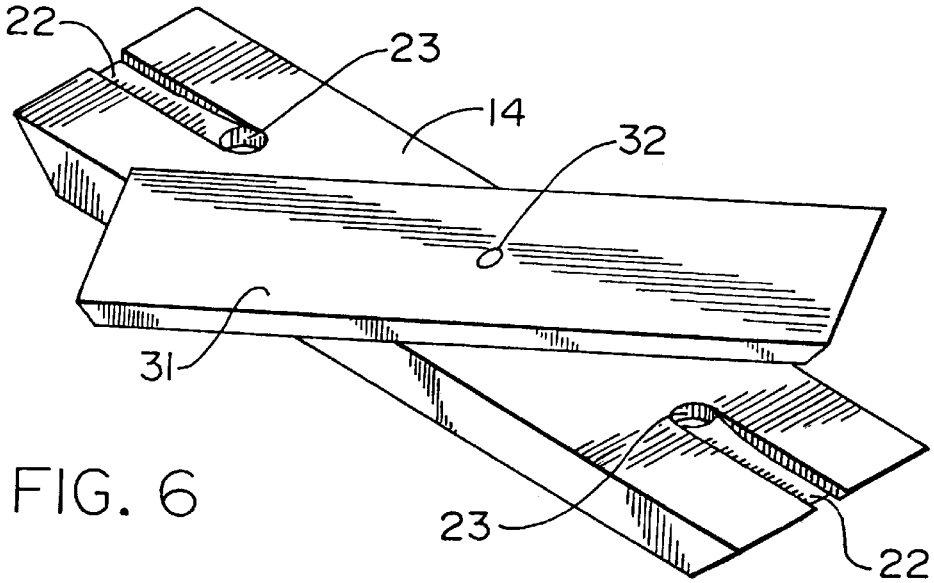
FIG. 6 is a perspective view of a side panel and stabilizing board of the frame according to the present invention.

To stabilize frame 10 after it is resting on a surface, a board 31 is pivotally mounted via a bolt 32 to the outer surface of side panel 14, as shown in FIGS. 2, 3 and 6. When frame 10 is being transported or is not in use, board 31 is pivoted to lie parallel to side panel 14 and stay out of the way. When frame 10 is placed on a surface to be displayed, board 31 is pivoted to be perpendicular to side panel 14 and serves to stabilize frame 10, along with platforms 21, when it is set in an upright position for display of a replacement window contained therein.

A major advantage of this type of frame over prior art frames is its ease of assembly. No tools are needed and the entire frame can be assembled within a few minutes. In its disassembled state, the frame can be stacked into a compact shape and easily shipped at a much lower cost than a fully assembled frame, as it only occupies about ⅓ the space of a fully-assembled frame. The frame can also be made in any shape or size, to accommodate different windows.

Accordingly, while only one embodiment of the present invention has been shown and described, it is obvious that many changes and modifications may be made thereunto without departing from the spirit and scope of the invention.

What is claimed is:

1. A replacement window display frame comprising:

a top panel having an inner surface defining a channel, an outer surface, and two ends;

two side panels, each side panel comprising an outer surface, an inner surface defining a channel, two ends, a longitudinal groove extending from each end of each side panel along the outer surface of each side panel to an end point, and a bore located adjacent the end point of each groove on the outer surface of each side panel;

a bottom panel having an inner surface defining a channel, an outer surface and two ends;

four L-shaped corner brackets mounted one on each end of said top and bottom panels, each corner bracket comprising two legs, each leg having a front section, two side sections connected to the front section and perpendicular thereto, and inwardly flanged edges connected to the side sections, said flanged edges extending parallel to the front section and wrapping around and engaging the inside surface of said top, bottom and side panels so that each end of said top and bottom panels fits snugly between the front section and the flanged edges, leaving a free leg for attachment to a side panel, each free leg having a protrusion located on an inner surface of the corner bracket;

wherein the frame is assembled by sliding the side panels between the front section and the flanged edges of the free leg of the corner brackets and sliding the grooves in the side panels along the protrusions in the corner brackets until the protrusions snap into the bores in the side panels, to permanently lock the side panels to the corner brackets.

2. The frame according to claim 1, wherein each end of said panels has beveled ends so that the outer surface of each panel is longer than the inner surface of each panel, such that upon assembly, the ends of adjacent panels fit together to form right angles.

3. The frame according to claim 2, wherein the ends of the panels are beveled at a 45° angle.

4. The frame according to claim 1, further comprising platforms integrally formed with the outer surface of at least two of the corner pieces, said platforms extending outward from the legs of the corner brackets and protecting the frame from abrasion when the frame is placed on a surface.

5. The frame according to claim 4, further comprising an elongated board pivotally mounted to one of said side panels, wherein said board stabilizes the frame in an upright position when said board is pivoted perpendicular to the side panels.

6. The frame according to claim 1, further comprising a handle attached to the outer surface of one of the panels.

7. The frame according to claim 1, wherein the bores have a depth greater than that of the grooves.

8. The frame according to claim 1, wherein the corner brackets are made of plastic.

9. The frame according to claim 1, wherein the corner brackets are secured to the top and bottom panels with a rivet.

10. The frame according to claim 1, wherein the corner brackets are formed from vacuum-extruded particle board.

11. A replacement window display frame comprising:

a top panel having an inner surface defining a channel, an outer surface, and two ends;

two side panels, each side panel comprising an outer surface, an inner surface defining a channel, two ends, a longitudinal groove extending from each end of each side panel along the outer surface of each side panel to an end point, and a bore located adjacent the end point of each groove on the outer surface of each side panel;

a bottom panel having an inner surface defining a channel, an outer surface and two ends;

four L-shaped corner brackets mounted one on each end of said top and bottom panels, each corner bracket comprising two legs, each leg having a front section, two side sections connected to the front section and perpendicular thereto, and inwardly flanged edges connected to the side sections, said flanged edges extending parallel to the front section and wrapping around and engaging the inside surface of said top, bottom and side panels so that each end of said top and bottom panels fits snugly within the flanged edges, leaving a free leg for attachment to a side panel, each free leg having a protrusion located on an inner surface of the corner bracket; and a replacement window secured within the channels on the inside surfaces of the top, bottom and side panels;

wherein the frame is assembled around the replacement window by sliding the side panels between the front section and the flanged edges of the free leg of the corner brackets, and sliding the grooves in the side panels along the protrusions in the corner brackets until the protrusions snap into the bores in the side panels, to permanently lock the side panels to the corner brackets.

* * * * *